US006290071B1

(12) United States Patent
Fisher et al.

(10) Patent No.: US 6,290,071 B1
(45) Date of Patent: Sep. 18, 2001

(54) AIR SEPARATOR SYSTEM

(75) Inventors: Gene Fisher; Greg L. Schafer, both of Dickinson, ND (US)

(73) Assignee: General Steel and Supply Company, Dickinson, ND (US)

( * ) Notice: Subject to any disclaimer, the term of this patent is extended or adjusted under 35 U.S.C. 154(b) by 0 days.

(21) Appl. No.: 09/468,443

(22) Filed: Dec. 21, 1999

(51) Int. Cl.[7] ..... B04B 5/12
(52) U.S. Cl. ..... 209/714; 209/713
(58) Field of Search ..... 209/710, 713, 209/714, 722, 139.1, 142, 143, 154

(56) References Cited

U.S. PATENT DOCUMENTS

| | | | | |
|---|---|---|---|---|
| 1,457,110 | * | 5/1923 | Gay | 209/722 |
| 2,030,612 | * | 2/1936 | Sturtevant | 209/714 |
| 3,237,766 | * | 3/1966 | Humphreys | 209/714 |
| 4,363,725 | * | 12/1982 | Morita et al. | 209/257 |
| 4,694,994 | * | 9/1987 | Henne et al. | 241/79.1 |
| 5,232,098 | * | 8/1993 | St-Pierre et al. | 209/240 |
| 6,092,748 | * | 7/2000 | Keyssner et al. | 241/47 |

* cited by examiner

*Primary Examiner*—Donald P. Walsh
*Assistant Examiner*—Joseph Rodriguez

(74) *Attorney, Agent, or Firm*—Michael S. Neustel

(57) ABSTRACT

An air separator system for separating particulate material into coarse and fine particles without utilizing water. The inventive device includes a trailer, a support frame pivotally attached to the trailer, a tapering body having an outer wall and an inner wall, a motor secured to the body, a funnel connected to a center tube rotatably attached within the body, and a fan structure attached to the lower portion of the center tube for agitating and blowing upon particulate material that enters the funnel from a feed conveyor. A plurality of upper regular members are pivotally attached within the upper portion of the outer cavity created between the outer wall and the inner wall for adjusting the amount of air flow into the outer cavity. A plurality of lower regulator members are attached within the inner wall for allowing the air to return upwardly toward the fan structure during operation to lift the lighter particulate material. The fan structure is preferably comprised of a lower plate spaced below the lower opening of the center tube, a plurality of upper blades extending into the outer cavity, and a plurality of lower blades within the inner cavity. The upper blades are preferably larger in size than the lower blades. In operation, the fine material is lifted upwardly toward the outer cavity where it is eventually dispensed through a lower outer discharge nozzle. The coarse material falls into the inner cavity defined by the inner wall where it is eventually dispensed through an inner discharge nozzle separate from the fine material.

4 Claims, 9 Drawing Sheets

AIR SEPARATOR SYSTEM

BACKGROUND OF THE INVENTION

1. Field of the Invention

The present invention relates generally to particulate material separators and more specifically it relates to an air separator system for separating particulate material into coarse and fine particles without utilizing water.

2. Description of the Prior Art

Conventional gravel separators have been in use for years. Typically, conventional gravel separator devices require the utilization of significant amounts of water to separate the gravel into course and fine materials.

One of the main problems with conventional gravel separators is that they require significant amounts of water which is not available in all locations. Another problem is that the water within the separated gravel cools the temperature of the asphalt within an asphalt mixer thereby requiring more time and energy to heat the asphalt to the desired temperature.

Examples of separating devices designed for other uses include U.S. Pat. No. 1,457,110 to Gay; U.S. Pat. No. 2,169,680 to Crites; U.S. Pat. No. 2,070,650 to Crites; U.S. Pat. No. 1,783,357 to Cook; U.S. Pat. No. 441,372 to Morse; U.S. Pat. No. 1,779,993 to Sturtevant; U.S. Pat. No. 5,934,483 to Kolacz; U.S. Pat. No. 2,748,668 to Hornbostel; U.S. Pat. No. 2,199,015 to Toensfeldt; U.S. Pat. No. 1,367,637 to Sturtevant; U.S. Pat. No. 687,266 to Raymond which are all illustrative of such prior art.

While these devices may be suitable for the particular purpose to which they address, they are not as suitable for separating particulate material into coarse and fine particles without utilizing water. Conventional gravel separators require significant amounts of water which is undesirable.

In these respects, the air separator system according to the present invention substantially departs from the conventional concepts and designs of the prior art, and in so doing provides an apparatus primarily developed for the purpose of separating particulate material into coarse and fine particles without utilizing water.

SUMMARY OF THE INVENTION

In view of the foregoing disadvantages inherent in the known types of gravel separators now present in the prior art, the present invention provides a new air separator system construction wherein the same can be utilized for separating particulate material into coarse and fine particles without utilizing water.

The general purpose of the present invention, which will be described subsequently in greater detail, is to provide a new air separator system that has many of the advantages of the gravel separators mentioned heretofore and many novel features that result in a new air separator system which is not anticipated, rendered obvious, suggested, or even implied by any of the prior art gravel separators, either alone or in any combination thereof.

To attain this, the present invention generally comprises a trailer, a support frame pivotally attached to the trailer, a tapering body having an outer wall and an inner wall, a motor secured to the body, a funnel connected to a center tube rotatably attached within the body, and a fan structure attached to the lower portion of the center tube for agitating and blowing upon particulate material that enters the funnel from a feed conveyor. A plurality of upper regular members are pivotally attached within the upper portion of the outer cavity created between the outer wall and the inner wall for adjusting the amount of air flow into the outer cavity. A plurality of lower regulator members are attached within the inner wall for allowing the air to return upwardly toward the fan structure during operation to lift the lighter particulate material. The fan structure is preferably comprised of a lower plate spaced below the lower opening of the center tube, a plurality of upper blades extending into the outer cavity, and a plurality of lower blades within the inner cavity. The upper blades are preferably larger in size than the lower blades. In operation, the fine material is lifted upwardly toward the outer cavity where it is eventually dispensed through a lower outer discharge nozzle. The coarse material falls into the inner cavity defined by the inner wall where it is eventually dispensed through an inner discharge nozzle separate from the fine material.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide an air separator system that will overcome the shortcomings of the prior art devices.

A second object is to provide an air separator system for separating particulate material into coarse and fine particles without utilizing water.

Another object is to provide an air separator system that does not utilize water to separate particulate material.

An additional object is to provide an air separator system that increases the efficiency of asphalt production.

A further object is to provide an air separator system that reduces the amount of time and energy to mix and heat asphalt.

Another object is to provide an air separator system that allows adjustment of the type of particulate material separated.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
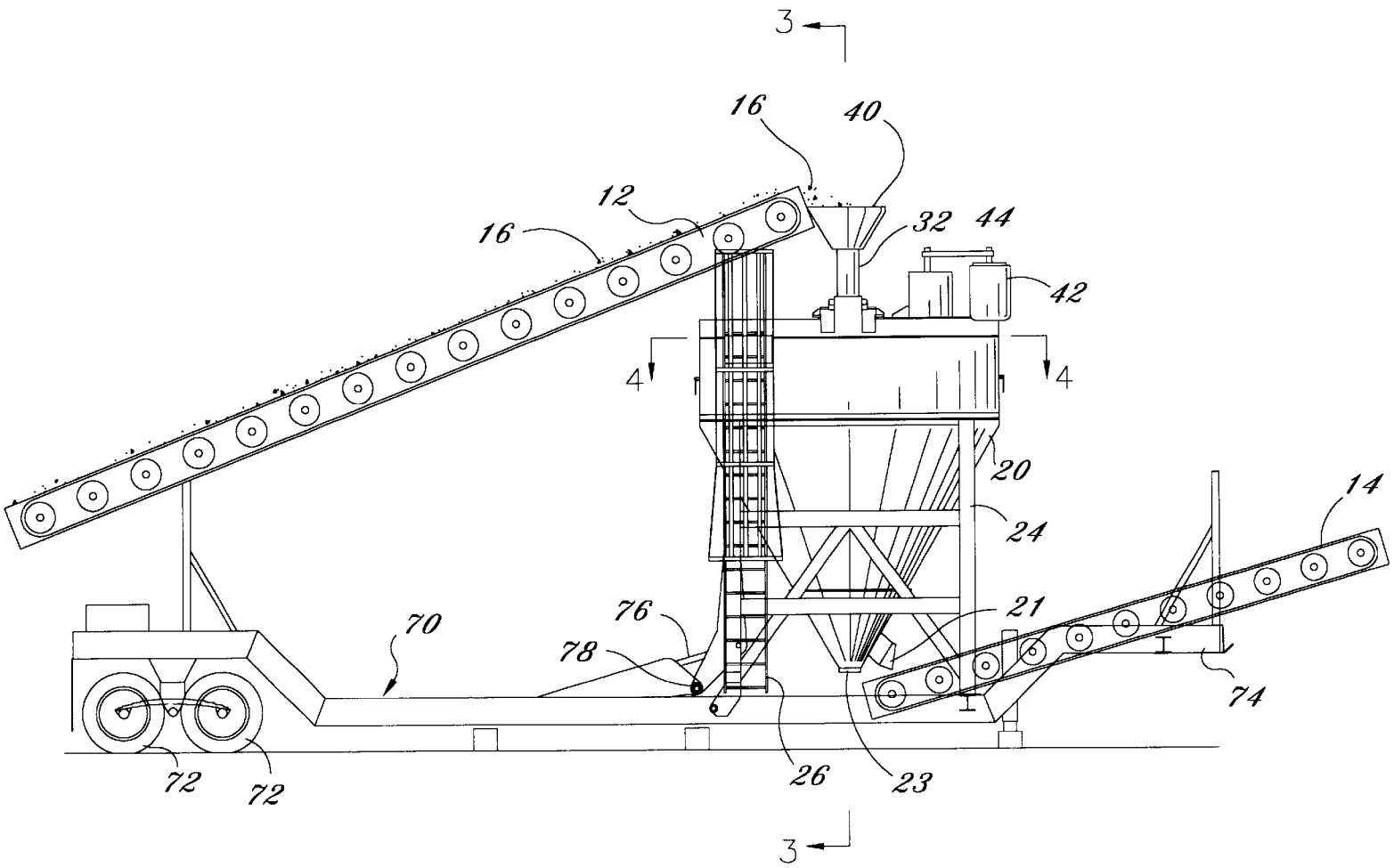
FIG. 1 is a side view of the present invention in an upright position.

Turning now descriptively to the drawings, in which similar reference characters denote similar elements throughout the several views, FIGS. 1 through 9 illustrate an air separator system 10, which comprises a trailer 70, a support frame 24 pivotally attached to the trailer 70, a tapering body having an outer wall 20 and an inner wall 22, a motor 42 secured to the body, a funnel 40 connected to a center tube 32 rotatably attached within the body, and a fan structure 30 attached to the lower portion of the center tube 32 for agitating and blowing upon particulate material 16 that enters the funnel 40 from a feed conveyor 12. A plurality of upper regular members are pivotally attached within the upper portion of the outer cavity 29 created between the outer wall 20 and the inner wall 22 for adjusting the amount of air flow into the outer cavity 29. A plurality of lower regulator members 60 are attached within the inner wall 22 for allowing the air to return upwardly toward the fan structure 30 during operation to lift the lighter particulate material 16. The fan structure 30 is preferably comprised of a lower plate 34 spaced below the lower opening of the center tube 32, a plurality of upper blades 38 extending into the outer cavity 29, and a plurality of lower blades 39 within the inner cavity 28. The upper blades 38 are preferably larger in size than the lower blades 39. In operation, the fine material 19 is lifted upwardly toward the outer cavity 29 where it is eventually dispensed through a lower outer discharge nozzle 23. The coarse material falls into the inner cavity 28 defined by the inner wall 22 where it is eventually dispensed through an inner discharge nozzle 21 separate from the fine material 19.

Figure 2:
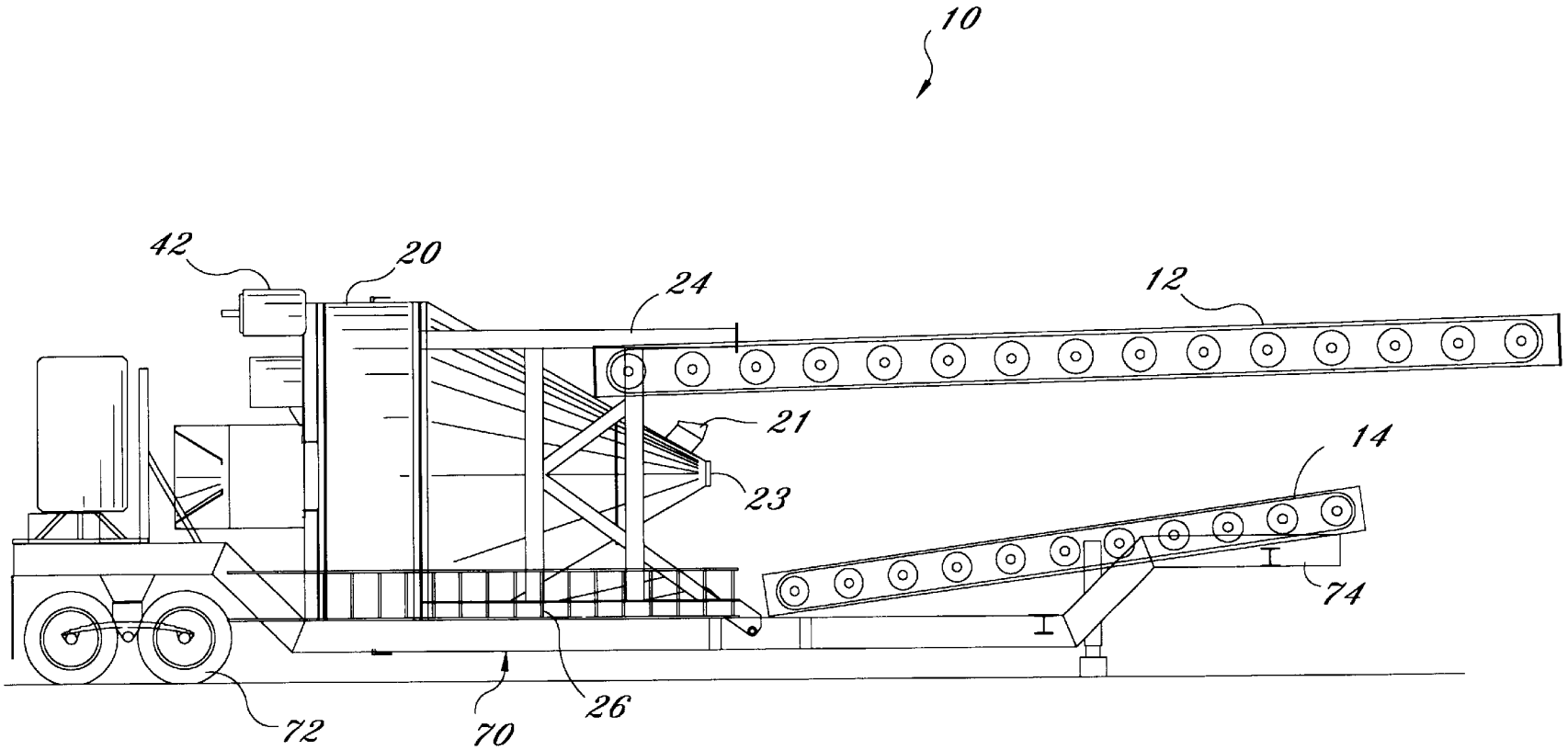
FIG. 2 is a side view of the present invention in a storage position.

As shown in FIGS. 1 and 2 of the drawings, the trailer 70 is an elongated structure having a plurality of wheels 72 rotatably attached along with a hitch 74 for allowing easy transportation of the present invention to various locations. It can be appreciated that the trailer 70 is conventional in the art and that various other well known trailer 70 designs and structures may be utilized tom comprise the trailer 70.

As shown in FIGS. 1 and 2 of the drawings, a support frame 24 is provided that is attached to the trailer 70. The support frame 24 is preferably attached to the trailer 70 by at least one hinge 78 for allowing pivoting of the present invention upon the trailer 70 for storage and transportation as shown in FIGS. 1 and 2 of the drawings. At least one hydraulic cylinder 76 is utilized to mechanically lower and raise the support frame 24 from an upright position to a lowered position as shown in FIGS. 1 and 2 of the drawings. It can be appreciated that the support frame 24 may be comprised of any well-known structure or design to support the present invention and should not be limited to this disclosure. In addition, an access ladder 26 is provided that is attached to the support frame 24 and the outer wall 20 for allowing an individual to control the operation of the present invention.

Figure 3:
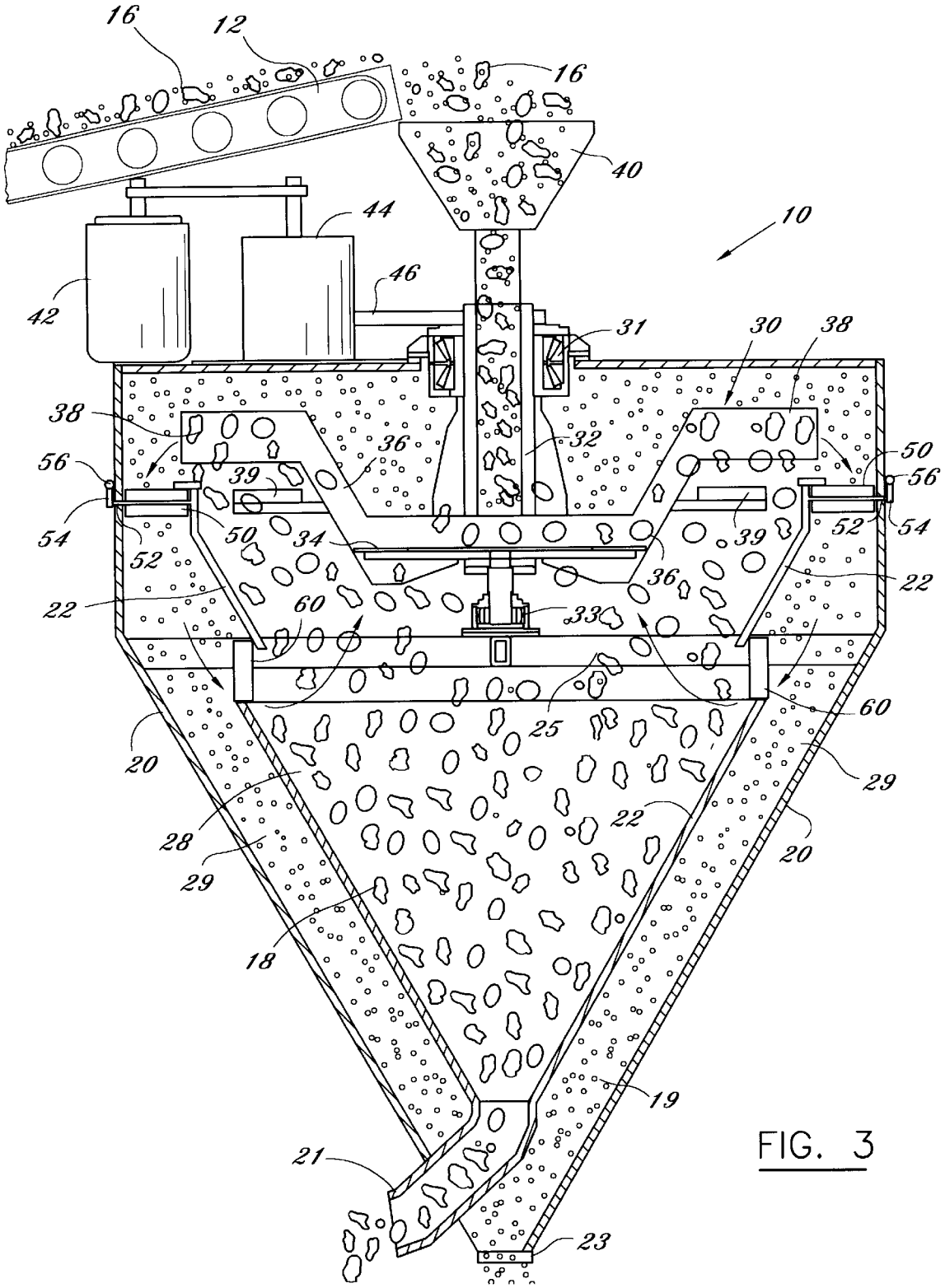
FIG. 3 is a cross sectional view taken along line 3—3 of FIG. 1.

As shown in FIGS. 1 and 2 of the drawings, an outer wall 20 is attached to the support frame 24 and supported thereby. The outer wall 20 preferably has a broad upper portion and a tapering mid-section to lower section forming a conical shape. It can be appreciated that the outer wall 20 may have various other shapes and designs. The outer wall 20 is preferably enclosed at the upper end thereof as shown in FIG. 3 of the drawings. The lower end of the outer preferably is comprised of an outer discharge nozzle 23 for releasing fine material 19 separated from within the present invention upon an exit conveyor 14 or other apparatus.

Figure 7:
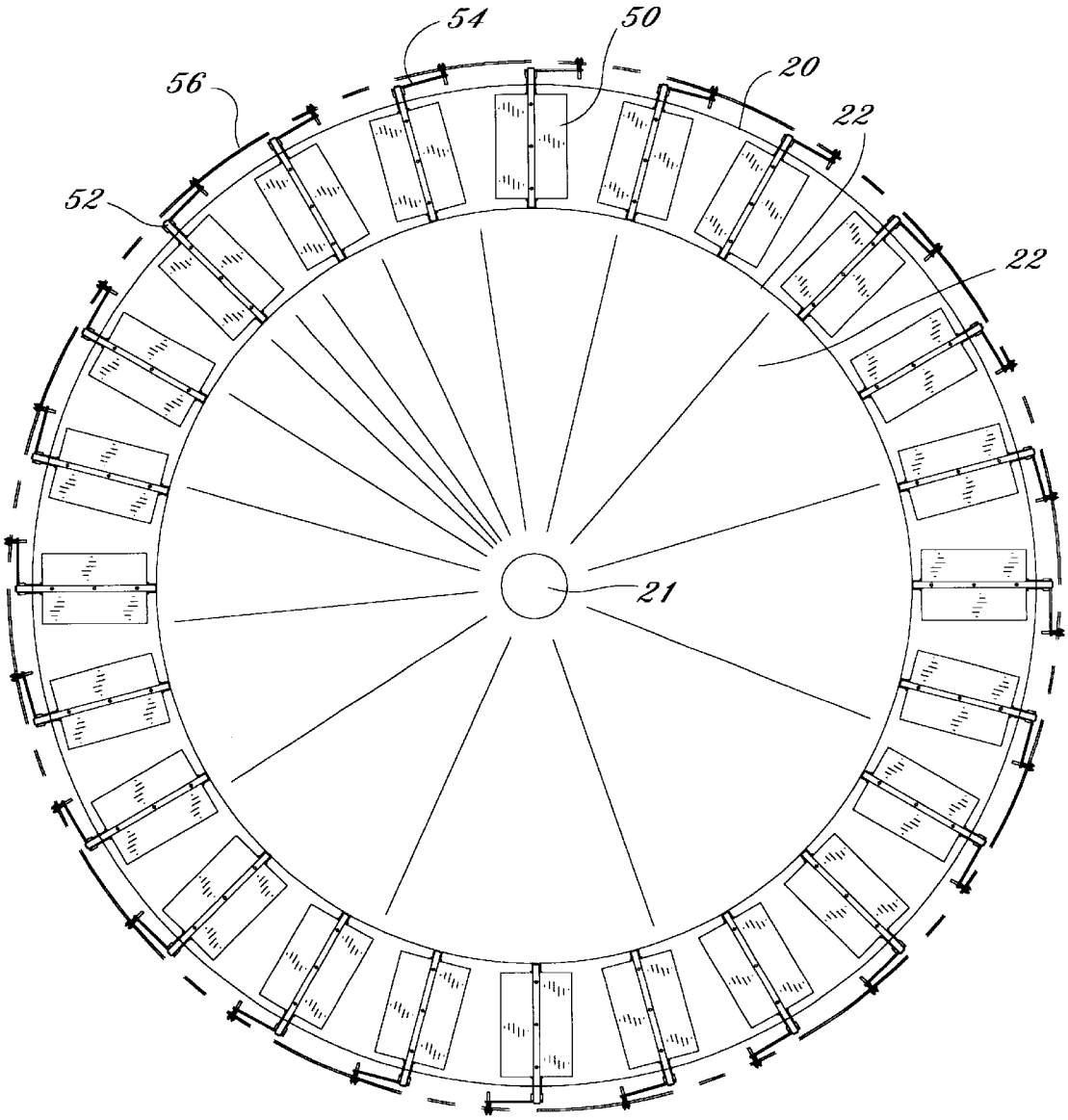
FIG. 7 is a top view of the interior of the present invention without the fan structure.
Figure 8:
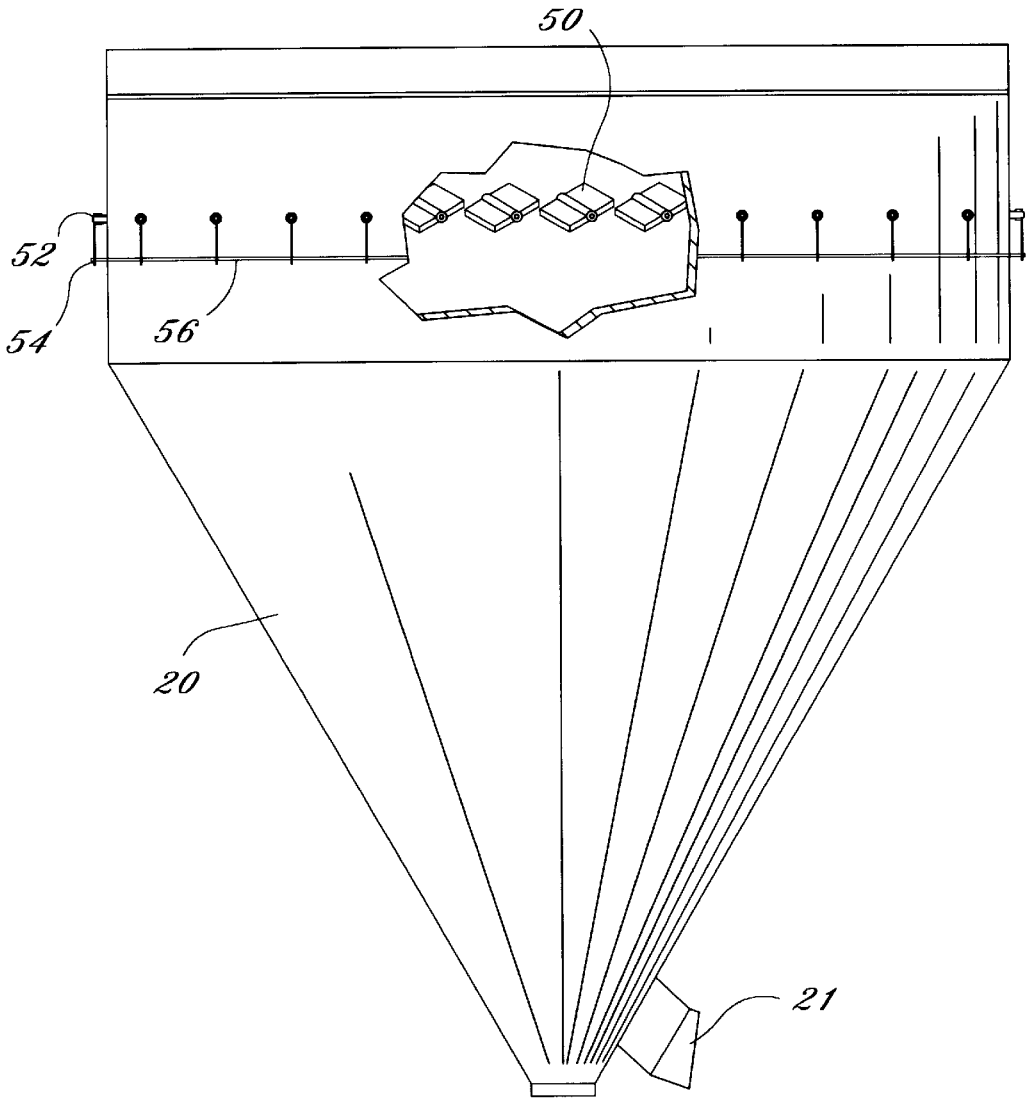
FIG. 8 is a side cutaway view of the present invention showing the upper regulator members.

As best shown in FIGS. 3 and 7 of the drawings, an inner wall 22 is attached in a spaced relationship within the outer wall 20 forming an outer cavity 29 between the inner wall 22 and the outer wall 20. The inner wall 22 does not extend completely to the upper portion of the outer wall 20 as best shown in FIG. 3 of the drawings. The upper edge of the inner wall 22 is preferably flanged as further shown in FIG. 3 of the drawings to extend over a portion of the upper regulator members 50. As further shown in FIG. 3 of the drawings, the inner wall 22 substantially parallels the shape of the outer wall 20 forming a consistent outer cavity 29 between the inner wall 22 and the outer wall 20. The inner wall 22 forms a tapering inner cavity 28 for receiving the heavier course material 18 which is discharged through an inner discharge nozzle 21 in the lower portion of the inner wall 22 that extends through the outer wall 20 as shown in FIG. 3 of the drawings.

As shown in FIGS. 1 and 3 of the drawings, a center tube 32 is rotatably supported within the outer wall 20 of the present invention. The center tube 32 is an elongate structure having an upper end and a lower end. The upper end of the center tube 32 receives a funnel 40 for guiding particulate material 16 containing course material 18 and fine material 19 from a feed conveyor 12 into the inner cavity 28 of the present invention. The center tube 32 is rotatably supported by an upper bearing 31 attached to the outer wall 20 as shown in FIG. 3 of the drawings. The upper bearing 31 may be comprised of any well-known bearing structure.

As best shown in FIG. 3 of the drawings, a fan structure 30 is attached to the lower portion of the center tube 32. As shown in FIG. 3 of the drawings, a plurality of cross beams 25 extend between the inner wall 22 and the outer wall 20 to rotatably support the fan structure 30 and the center tube 32. As shown in FIG. 3 of the drawings, a lower bearing 33 is attached to the cross beams 25 and pivotally supports the lower portion of the fan structure 30.

As best shown in FIG. 3 of the drawings, a motor 42 is attached to the outer surface of the present invention. A reduction box 44 is preferably mechanically connected to the motor 42 by conventional means for reducing the rotational velocity prior to rotating the center tube 32. As shown in FIG. 3, a drive belt 46 or other connection means is mechanically connected between the reduction box 44 and the center tube 32 for rotating the center tube 32. It can be appreciated that various other power means and gear reduction means may be utilized to effectively rotate the center tube 32 along with the fan structure 30.

As shown in FIGS. 3 through 7 of the drawings, the fan structure 30 comprises a plurality of armatures 36 that are attached to the lower portion of the center tube 32. As further shown in FIGS. 3 through 7, a plurality of upper blades 38 are attached to the distal ends of the armatures 36. A shown in FIGS. 3 through 7, a plurality of lower blades 39 are attached to the armatures 36 between the center tube 32 and the upper blades 38. The lower blades 39 and the upper blades 38 may have any well-known shape and structure. In addition, the lower blades 39 and the upper blades 38 may have any angle depending upon the desired use of the product.

Figure 6:
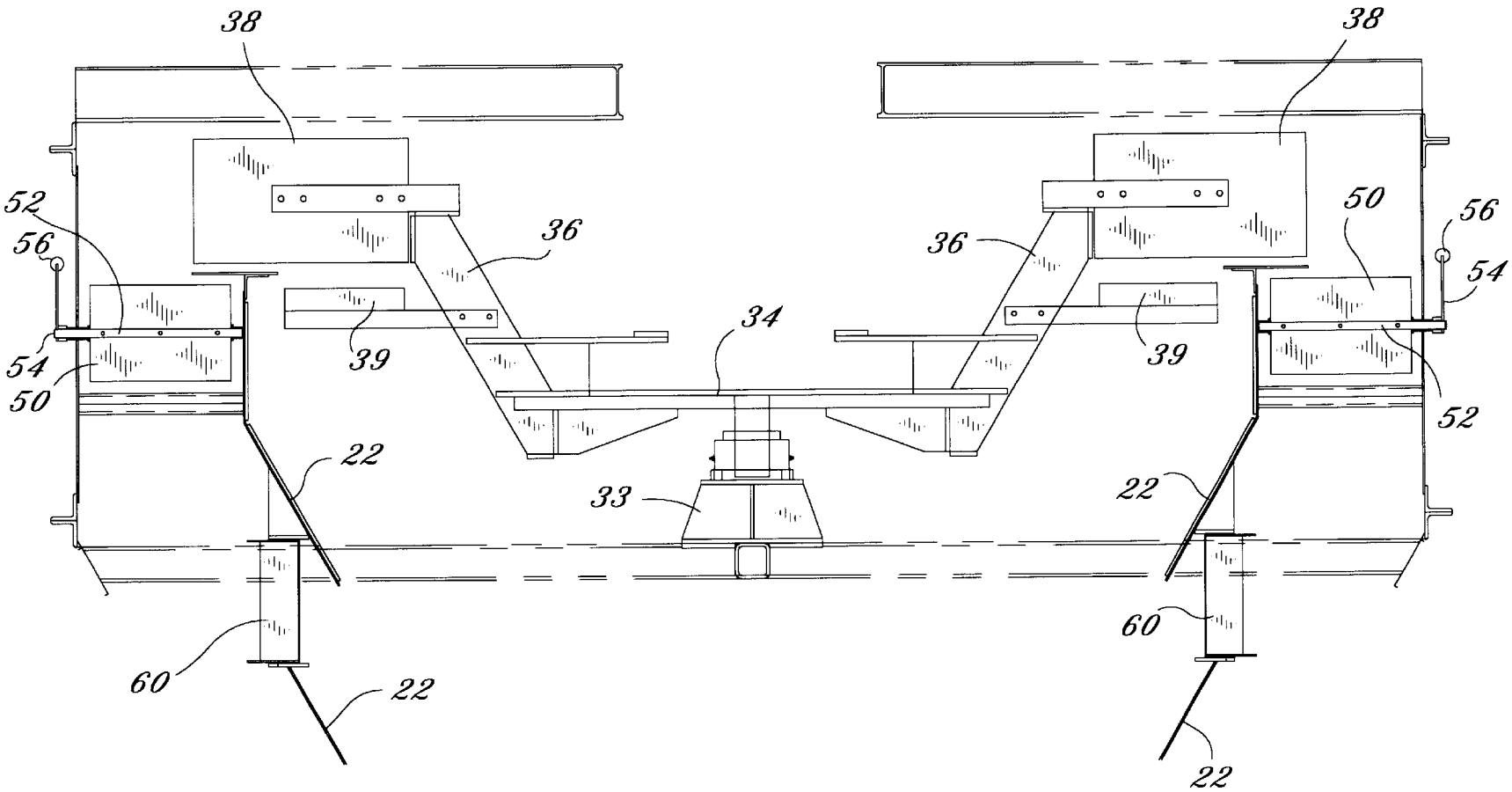
FIG. 6 is a magnified side cutaway view of the interior of the present invention.

As best shown in FIGS. 3 and 6 of the drawings, a lower plate 34 is attached to the plurality of armatures 36. The lower plate 34 is positioned a finite distance below the lower end of the center tube 32 for allowing the particulate material 16 to pass through the center tube 32. The armatures 36 preferably extend above the upper surface of the lower plate 34 near the outer perimeter for engaging the particulate material 16 and throwing the particulate material 16 against the inner wall 22 during operation.

As shown in FIGS. 3, 4, 6, 7 and 8 of the drawings, a plurality of upper regulator members 50 are attached about a shaft 52. The shaft 52 is rotatably attached between the inner wall 22 and the outer wall 20 near the upper portion thereof for allowing adjustment of the airflow that flows into the outer cavity 29 during operation of the present invention. Each shaft 52 is preferably attached between the outer wall 20 and the inner wall 22 along a horizontal axis extending radially toward the center axis of the invention. The upper regulator members 50 may have any well-known shape and structure as can be appreciated.

Each shaft 52 attached to the upper regulator members 50 rotatably extends through the outer wall 20 wherein a control arm 54 is attached to the each shaft 52. As best shown I FIGS. 4 and 7 of the drawings, each shaft 52 preferably extends from the outer wall 20 to the inner wall 22 radially with respect to the center tube 32.

Figure 4:
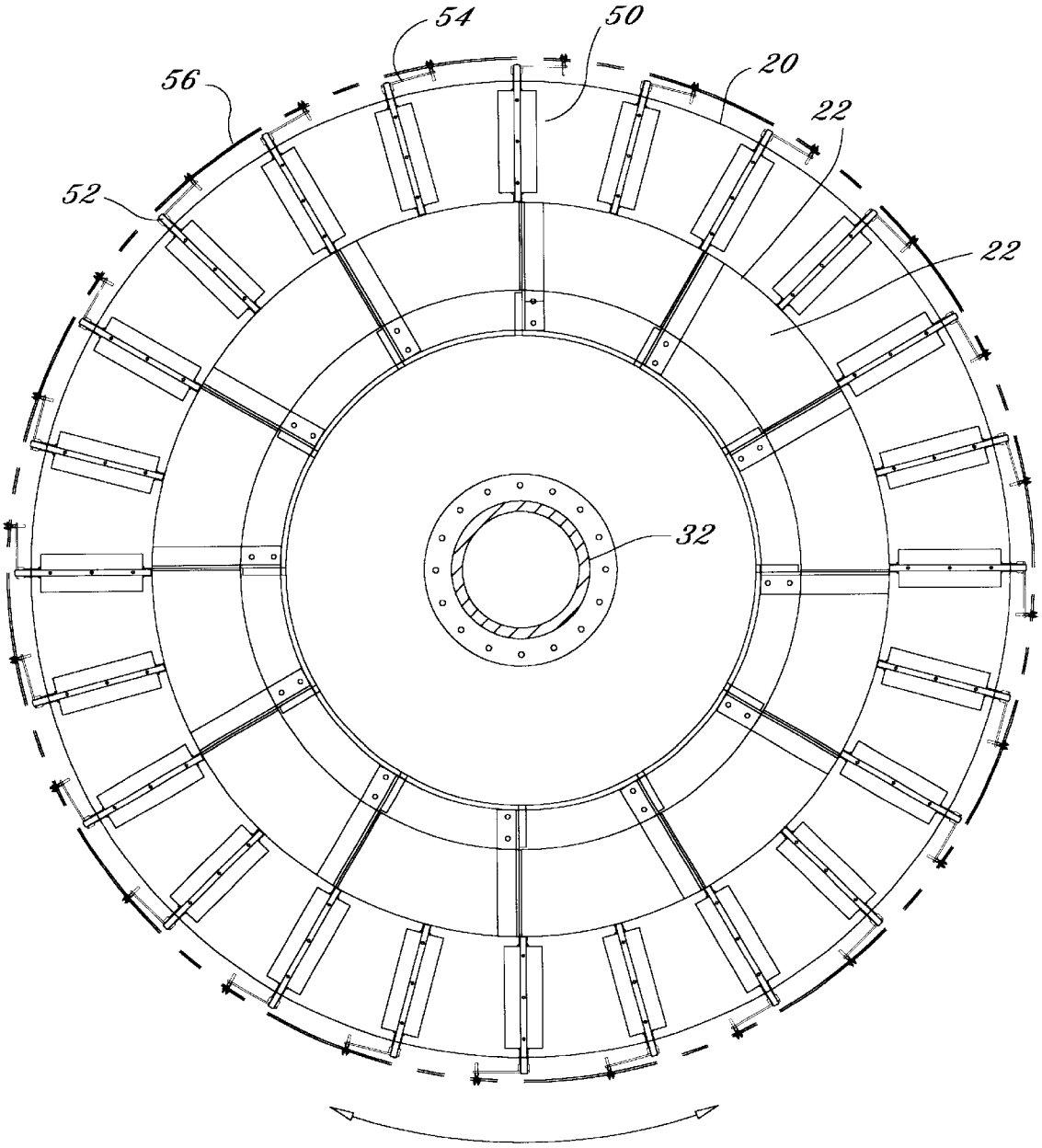
FIG. 4 is a cross sectional view taken along line 4—4 of FIG. 1.
Figure 5:
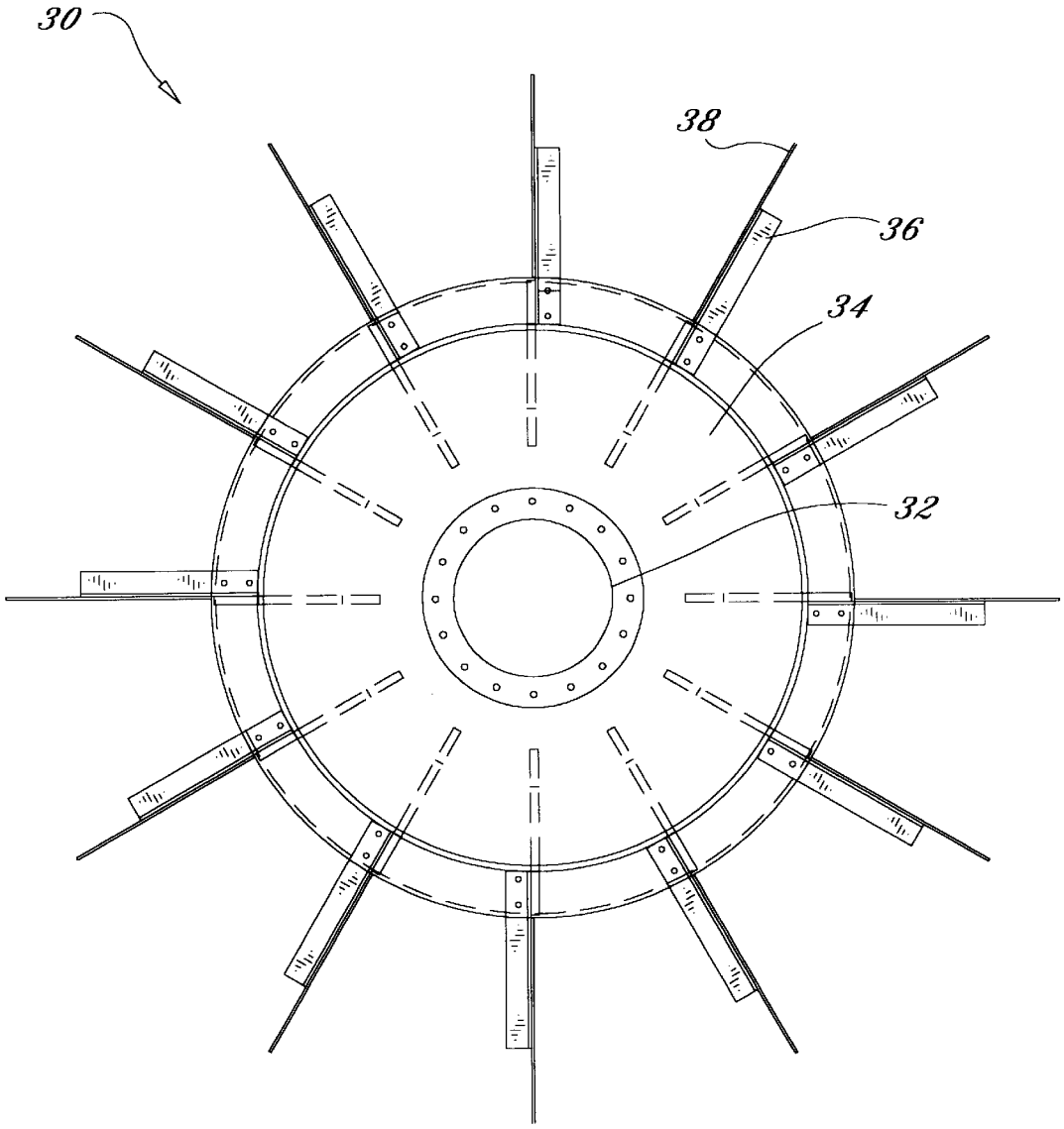
FIG. 5 is a top view of the fan structure.

As best shown in FIGS. 3, 4, 6, 7, 8 and 9 of the drawings, the control arm 54 for each of the upper regulator members 50 is attached to a common control cable 56 that extends about the perimeter of the invention as best shown in FIG. 4 of the drawings. The user manipulates the position of the control cable 56 to allow synchronous adjustment of the rotational position of the upper regulator members 50 thereby allowing adjustment of the airflow through the outer cavity 29.

Figure 9:
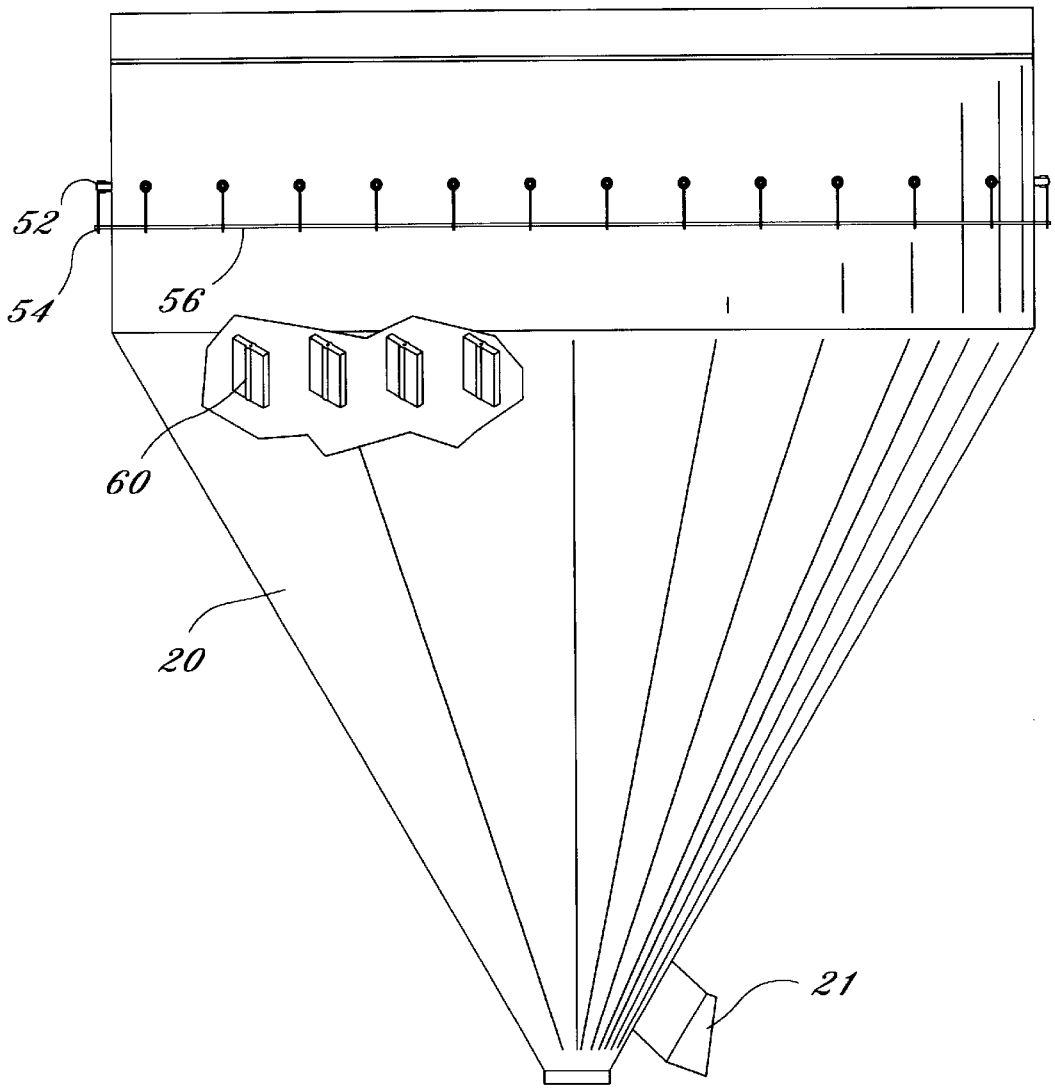
FIG. 9 is a side cutaway view of the present invention showing the lower regulator members.

As best shown in FIGS. 3, 6 and 9 of the drawings, a plurality of lower regulator members 60 are rotatably positioned within a radial slot within the inner wall 22 for allowing adjustment of the air flow from the outer cavity 29 back into the inner cavity 28. As shown in FIGS. 3 and 6 of the drawings, the lower regulator members 60 are preferably orientated along a vertical axis for allowing adjustment of the return airflow. The lower regulator members 60 are generally open for allowing the maximum return of air flow from the outer cavity 29, however it sometimes is preferable to adjust the relative angle of the lower regulator members 60 to cause the return air to enter the inner cavity 28 at a rotational velocity for increasing the agitation of the particulate material 16 after entering the inner cavity 28.

In use, mined particulate material 16, such as gravel, is placed upon a feed conveyor 12 that transports the particulate material 16 to the funnel 40. The particulate material 16 is deposited within the funnel 40 as best shown in FIG. 1 of the drawings. The particulate material 16 then passes through the rotating center tube 32 as shown in FIG. 3 of the drawings until it passes through the lower opening of the center tube 32 and engages the lower plate 34. The particulate material 16 is forced to the outer portions of the lower plate 34 by centrifugal forces where a majority of the material is engaged by the armatures 36 which throw the particulate material 16 toward the inner wall 22 of the invention. As the fan structure 30 rotates, the air is forced upwardly and outwardly toward the upper portion of the outer cavity 29 where it passes through the upper regulator members 50 and exits below the fan structure 30 through the lower regulator members 60 as shown in FIG. 3 of the drawings. The lighter fine material 19 is lifted by the airflow within the inner cavity 28 and forced upwardly and outwardly into the outer cavity 29 through the upper regulator members 50. The heavier coarse material 18 is not lifted by the air flow and falls downwardly into the inner cavity 28 as shown in FIG. 3 thereby separating the coarse material 18 from the fine material 19 within the particulate material 16. The fine material 19 passes downwardly within the outer cavity 29 until it passes through the outer discharge nozzle 23 where it can be transported to a desired location separate from the coarse material 18. The lower regulator members 60 are preferably slightly angled to reduce the amount of fine material 19 that enters into the inner cavity 28 as the air flows back into the inner cavity 28. The coarse material descends downwardly within the inner cavity 28 until it is emitted through the inner discharge nozzle 21 where it can be transported to a desired location. The upper regulator members 50 may be adjusted to control the amount of airflow through the outer cavity 29 thereby controlling the size and weight of the material that is forced through the outer cavity 29. If the user desires to increase the size and weight of the particles that pass through the outer cavity 29, the user simply positions the upper regulator members 50 in a more vertical position thereby increasing the airflow into the outer cavity 29. If the user desired to decrease the size and weight of the particles that pass through the outer cavity 29, the user simply positions the upper regulator members 50 in a more horizontal position thereby reducing the airflow into the outer cavity 29. To increase the agitation of the particulate material 16 during separation, the user typically will angle the lower regulator members 60 to rotate the upward airflow within the inner cavity 28 during operation of the present invention. The lower regulator members 60 also reduce the amount of fine material 19 that passes back into the inner cavity 28 by deflecting the fine material 19 that attempts to pass there through. When finished utilizing the present invention, the user controls the hydraulic cylinder 76 so that it lowers the support frame 24 into a horizontal position upon the trailer 70 thereby allowing transportation of the present invention to various locations.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An air separator system for separating particulate material into coarse material and fine material, comprising:

a housing having an outer wall and an inner wall in a spaced relationship defining an outer cavity between thereof, wherein said inner wall defines an inner cavity;

an outer discharge nozzle within said outer wall for dispensing material within said outer cavity;

an inner discharge nozzle within said inner wall extending through said outer wall for dispensing material within said inner cavity;

a return opening within said inner wall for allowing air from within said outer cavity to return to said inner cavity;

a fan structure rotatably positioned within said housing for forcing airflow into said outer cavity;

a means for rotating said fan structure;

a means for providing particulate material above said fan structure; and a means for adjusting airflow into said outer cavity comprising a plurality of upper regulator members rotatably attached between said inner wall and said outer wall, wherein said plurality of upper regulator members each include a control arm that is attached to a common control cable that extends about an outer perimeter of said housing for allowing synchronous adjustment of the rotational position of each of said plurality of upper regulator members, wherein each said control arm is manipulated by said common control cable for rotating said plurality of upper regulator members;

wherein said return opening includes a plurality of lower regulator members rotatably positioned along a common vertical axis;

wherein said fan structure comprises a plurality of armatures, a plate attached to said plurality of armatures and rotatably supported within said housing, a plurality of lower blades attached to said plurality of armatures, and a plurality of upper blades attached to a distal end of said plurality of armatures.

2. The air separator system of claim 1, wherein said means for providing particulate material comprises:

a tube rotatably positioned within an upper portion of said housing and supporting said fan structure; and a funnel attached to an upper end of said tube for receiving particulate material.

3. An air separator system for separating particulate material into coarse material and fine material, comprising:

a housing having an outer wall and an inner wall in a spaced relationship defining an outer cavity between thereof, wherein said inner wall defines an inner cavity;

a trailer pivotally supporting said housing, wherein said housing is capable of being manipulated into a storage position and an upright position by at least one hydraulic cylinder;

an outer discharge nozzle within said outer wall for dispensing material within said outer cavity;

an inner discharge nozzle within said inner wall extending through said outer wall for dispensing material within said inner cavity;

a return opening within said inner wall for allowing air from within said outer cavity to return to said inner cavity;

a fan structure rotatably positioned within said housing for forcing airflow into said outer cavity;

a means for rotating said fan structure;

a means for providing particulate material above said fan structure; and a means for adjusting airflow into said outer cavity comprising a plurality of upper regulator members rotatably attached between said inner wall and said outer wall, wherein said plurality of upper regulator members each include a control arm that is attached to a common control cable that extends about an outer perimeter of said housing for allowing synchronous adjustment of the rotational position of each of said plurality of upper regulator members, wherein each said control arm is manipulated by said common control cable for rotating said plurality of upper regulator members;

wherein said return opening includes a plurality of lower regulator members rotatably positioned along a common vertical axis;

wherein said fan structure comprises a plurality of armatures, a plate attached to said plurality of armatures and rotatably supported within said housing, a plurality of lower blades attached to said plurality of armatures, and a plurality of upper blades attached to a distal end of said plurality of armatures.

4. The air separator system of claim 3, wherein said means for providing particulate material comprises:

a tube rotatably positioned within an upper portion of said housing and supporting said fan structure; and a funnel attached to an upper end of said tube for receiving particulate material.

* * * * *